US010068516B2

(12) United States Patent
Choi et al.

(10) Patent No.: US 10,068,516 B2
(45) Date of Patent: Sep. 4, 2018

(54) DISPLAY DEVICE HAVING TEMPERATURE COMPENSATION AND METHOD OF DRIVING THE SAME

(71) Applicant: Samsung Display Co., Ltd., Yongin (KR)

(72) Inventors: Nam-Gon Choi, Yongin-si (KR); Joon-Chul Goh, Hwaseong-si (KR); Gigeun Kim, Seoul (KR); Byungsun Kim, Seoul (KR); Jung-Won Kim, Seoul (KR); HongSoo Kim, Hwaseong-si (KR); Donggyu Lee, Seoul (KR); Jakyoung Jin, Daegu (KR); Bonghyun You, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 235 days.

(21) Appl. No.: 14/679,401

(22) Filed: Apr. 6, 2015

(65) Prior Publication Data

US 2016/0005365 A1 Jan. 7, 2016

(30) Foreign Application Priority Data

Jul. 2, 2014 (KR) ..... 10-2014-0082572

(51) Int. Cl.
*G09G 3/20* (2006.01)
*G09G 3/36* (2006.01)

(52) U.S. Cl.
CPC ..... *G09G 3/2007* (2013.01); *G09G 3/3607* (2013.01); *G09G 3/3611* (2013.01);
(Continued)

(58) Field of Classification Search
CPC .. G09G 3/2007; G09G 3/2074; G09G 3/3607; G09G 3/3611; G09G 3/3614;
(Continued)

(56) References Cited

U.S. PATENT DOCUMENTS

2001/0024199 A1* 9/2001 Hughes ..... G09G 3/3611 345/204
2007/0188430 A1* 8/2007 Moon ..... G09G 3/3648 345/89

(Continued)

FOREIGN PATENT DOCUMENTS

KR 10-0672654 1/2007
KR 10-2007-0074792 7/2007

(Continued)

*Primary Examiner* — Keith Crawley
(74) *Attorney, Agent, or Firm* — H.C. Park & Associates, PLC

(57) ABSTRACT

A display device includes a timing controller, a data driver, and a display panel. The timing controller includes a first compensator receiving a first image data, selecting a temperature compensation value in accordance with the external temperature, and converting the first image data to a second image data on the basis of the selected temperature compensation value and a second compensator selecting a kickback voltage compensation value predetermined in accordance with the areas of the display panel and converting the second image data to the output image data on the basis of the kickback voltage compensation value selected in accordance with the areas.

15 Claims, 15 Drawing Sheets

(52) U.S. Cl.
CPC ..... *G09G 3/3666* (2013.01); *G09G 3/3685* (2013.01); *G09G 2310/027* (2013.01); *G09G 2320/0242* (2013.01); *G09G 2320/0247* (2013.01); *G09G 2320/0276* (2013.01); *G09G 2320/0285* (2013.01); *G09G 2320/041* (2013.01)

(58) Field of Classification Search
CPC .. G09G 3/3648; G09G 3/3666; G09G 3/3685; G09G 3/3696; G09G 2310/027; G09G 2320/0223; G09G 2320/0233; G09G 2320/0242; G09G 2320/0247; G09G 2320/0276; G09G 2320/0285; G09G 2320/041
See application file for complete search history.

(56) References Cited

U.S. PATENT DOCUMENTS

2007/0229443 A1* 10/2007 Sawada ..... G09G 3/3611 345/101
2008/0224983 A1* 9/2008 Lee ..... G09G 3/3648 345/98
2009/0153533 A1* 6/2009 Umeda ..... G09G 3/3607 345/204
2009/0309903 A1* 12/2009 Park ..... G09G 3/3611 345/690
2011/0279466 A1* 11/2011 Park ..... G09G 3/3648 345/581
2012/0105422 A1* 5/2012 Zhao ..... G09G 3/36 345/212
2013/0249932 A1* 9/2013 Siotis ..... G09G 3/20 345/589
2014/0152630 A1* 6/2014 Koyama ..... G09G 3/3648 345/205
2015/0116373 A1 4/2015 Kim et al.

FOREIGN PATENT DOCUMENTS

KR 10-1016279 2/2011
KR 10-2015-0022160 3/2015

* cited by examiner

DISPLAY DEVICE HAVING TEMPERATURE COMPENSATION AND METHOD OF DRIVING THE SAME

CROSS-REFERENCE TO RELATED APPLICATION

This U.S. non-provisional patent application claims priority from and the benefit of Korean Patent Application No. 10-2014-0082572, filed on Jul. 2, 2014, which is hereby incorporated by reference for all purposes as if fully set forth herein.

BACKGROUND

Field

The present disclosure relates to a display device and a method of driving the same. More particularly, the present disclosure relates to a display device having a gamma compensation function and a method of driving the display device.

Discussion of the Background

Many electronic devices, such as smart phones, digital cameras, notebook computers, navigation devices, smart televisions, etc., include image display devices to display images.

As the image display device, a liquid crystal display, which controls intensity of an electric field applied to control a transmittance of light of a liquid crystal layer disposed between two substrates, is widely used to display a desired image.

The liquid crystal display has a gamma characteristic in which a gray-scale level of the image displayed in the liquid crystal display is non-linearly changed in accordance with a voltage level of an image signal. This is because the transmittance of the liquid crystal layer is non-linearly changed according to the intensity of the electric field and the gray-scale level of the image is non-linearly changed according to the transmittance of the liquid crystal layer.

SUMMARY

The present disclosure provides a display device having a uniform gamma characteristic over a display area regardless of an external temperature.

The present disclosure provides a method of driving the display device.

Additional features of the invention will be set forth in the description which follows, and in part will be apparent from the description, or may be learned by practice of the invention.

Exemplary embodiments of the inventive concept provide a display device including a timing controller to generate output image data, a data driver to convert the output image data to a data voltage, a display panel comprising a plurality of areas to display an image in accordance with the data voltage, and a temperature sensor to sense an external temperature, and the timing controller includes a first compensator to receive first image data, to select a temperature compensation value according to the external temperature, and to convert the first image data to second image data on the basis of the selected temperature compensation value, and a second compensator to select a kickback voltage compensation value according to an area from among the plurality of areas and to convert the second image data to the output image data on the basis of the selected kickback voltage compensation value.

Exemplary embodiments of the inventive concept provide a method of driving a display device, including generating output image data, converting the output image data to a data voltage, displaying an image in accordance with the data voltage, and sensing an external temperature, and the generating of the output image data includes receiving first image data, selecting a temperature compensation value in accordance with the external temperature, converting the first image data to second image data on the basis of the selected temperature compensation value, selecting a kickback voltage compensation value predetermined in accordance with a plurality of areas of a display panel according to the areas, and converting the second image data to the output image data on the basis of the kickback voltage compensation value selected according to the areas.

According to the above, the display device includes the first compensator to compensate for the image data in accordance with the external temperature and the second compensator to compensate the different kickback voltages generated in the areas of the display panel. Therefore, the difference in display quality due to the external temperature and the difference in display quality between the areas of the display panel, which is caused by the kickback voltages, are compensated, and thus the display device has a uniform display quality over the display areas thereof.

It is to be understood that both the foregoing general description and the following detailed description are exemplary and explanatory and are intended to provide further explanation of the invention as claimed. Other features and aspects will be apparent from the following detailed description, the drawings, and the claims.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION

Figure 1:
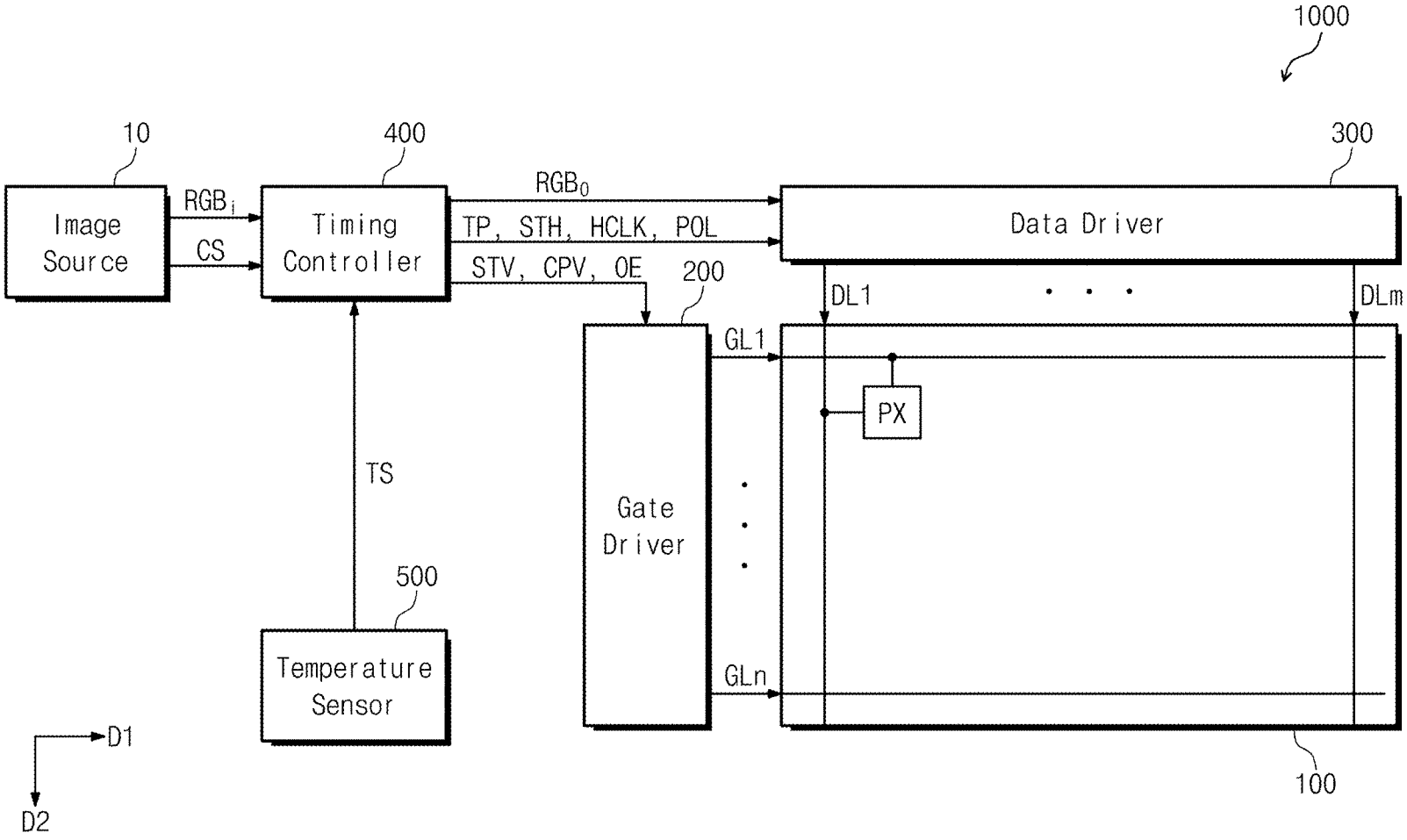
FIG. 1 is a block diagram showing a display device according to exemplary embodiments of the present disclosure.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

FIG. 1 is a block diagram showing a display device 1000 according to exemplary embodiments of the present disclosure.

Referring to FIG. 1, the display device 1000 includes a display panel to display an image, a gate driver 200 and a data driver 300 to drive the display panel 100, and a timing controller 400 to control the gate driver 200 and the data driver 300.

The timing controller 400 receives input image data $RGB_i$ and a plurality of control signals CS from an image source 10 provided outside of the timing controller 400. The image source 10 may be a variety of electronic devices, such as a personal computer, a television receiver, a video player, a digital cellular phone, a tablet, etc.

The timing controller 400 converts a data format of the input image data $RGB_i$ to a data format appropriate to an interface between the data driver 300 and the timing controller 400 and generates output image data $RGB_0$ to apply the output image data $RGB_0$ to the data driver 300. The timing controller 400 generates a data control signal and a gate control signal on the basis of the control signals CS and transmits the data control signal to the data driver 300 and the gate control signal to the gate driver 200. The data control signal includes an output start signal TP, a horizontal start signal STH, a polarity signal POL, and a clock signal HCLK, and the gate control signal includes a vertical start signal STV, a gate clock signal CPV, and an output enable signal OE.

The data control signal is applied to the data driver 300 and the gate control signal is applied to the gate driver 200.

The gate driver 200 sequentially outputs gate signals in response to the gate control signal provided from the timing controller 400.

The data driver 300 converts the output image data $RGB_0$ to data voltages in response to the data control signal provided from the timing controller 400.

The data driver 300 inverts a polarity of the data voltages in the unit of a frame and applies the data voltage to the display panel 100. In more detail, the data driver 300 converts the polarity of the output image data $RGB_0$ between a positive data voltage PDV (refer to FIG. 2) and a negative data voltage NDV (refer to FIG. 2) in response to the polarity signal POL. The positive and negative data voltages PDV and NDV are applied to the display panel 100.

The display panel 100 includes a plurality of gate lines GL1 to GLn, a plurality of data lines DL1 to DLm, and a plurality of pixels PX. For the convenience of explanation, only one pixel PX has been shown in FIG. 1.

The display panel 100 may be one of a variety of display panels, e.g., an organic light emitting display panel, a liquid crystal display panel, a plasma display panel, an electrophoretic display panel, an electrowetting display panel, etc. Hereinafter, the liquid crystal display panel will be described as the display panel 100 but aspects are not limited thereto.

The gate lines GL1 to GLn extend in a first direction D1 and are arranged in a second direction D2 substantially perpendicular to the first direction D1 to be substantially parallel to each other. The gate lines GL1 to GLn are connected to the gate driver 200 to receive the gate signals from the gate driver 200.

The data lines DL1 to DLm extend in the second direction D2 and are arranged in the first direction D1 to be substantially parallel to each other. The data lines DL1 to DLm are connected to the data driver 300 to receive the data voltages from the data driver 300.

Each of the pixels PX includes a thin film transistor (not shown) and a liquid crystal capacitor (not shown) and is connected to a corresponding gate line of the gate lines GL1 to GLn and a corresponding data line of the data lines DL1 to DLm. In more detail, the pixels PX are turned on or turned off in response to the gate signals applied thereto. The turned-on pixels PX display gray-scales corresponding to the data voltages applied thereto via the corresponding data line of the data lines DL1 to DLm.

The display device 1000 further includes a temperature sensor 500 that senses an external temperature and generates a temperature signal TS on the basis of the sensed external temperature. For instance, the temperature sensor 500 senses the temperature of air in the area in the vicinity of the display panel 100.

The temperature sensor 500 may be disposed in the display panel 100, but it should not be limited thereto or thereby. That is, the temperature sensor 500 may be disposed in a printed circuit board (not shown) on which the timing controller 400 is disposed, or a cover part (not shown) in which the display panel 100 and the printed circuit board are accommodated. The cover part may include a bottom chassis and a top chassis, and in this case, the temperature sensor 500 may be disposed at least one of the bottom chassis and the top chassis. Further, the temperature sensor 500 may include one or more sensors to sense or measure temperatures of one or more areas of the display panel 100 and/or of the display device 1000.

Figure 2:
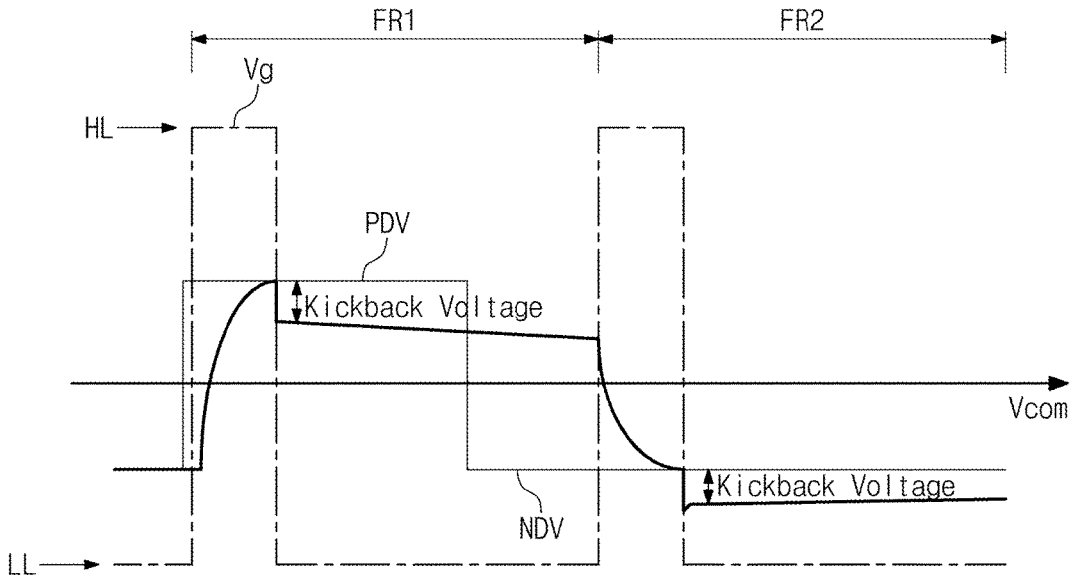
FIG. 2 is a view showing a kickback voltage generated in a display panel shown in FIG. 1.

FIG. 2 is a view showing a kickback voltage generated in the display panel 100 shown in FIG. 1.

Hereinafter, the kickback voltage will be described with reference to FIGS. 1 and 2.

When a voltage of the same polarity is continuously applied to the liquid crystal layer (not shown) of the display panel 100, the liquid crystal layer may be deteriorated. To decrease deterioration the liquid crystal layer, the data driver 300 periodically inverts the polarity of the data voltages applied to the display panel 100 in the unit of frame in response to the polarity signal POL (refer to FIG. 1). The polarity of the data voltages is inverted every one frame with respect to a common voltage Vcom applied to a common electrode (not shown).

In more detail, the positive data voltage PDV having a voltage level greater than that of the common voltage Vcom is applied to the display panel 100 in a first frame FR1 and the negative data voltage NDV having a voltage level smaller than that of the common voltage Vcom is applied to the display panel 100 in a second frame FR2.

During the first frame FR1, the liquid crystal capacitor is charged with the positive data voltage PDV while the thin film transistor receives the gate signal Vg at a high level HL. Then, when the gate signal Vg is changed to a low level LL, the voltage charged in the liquid crystal capacitor is lowered down to the kickback voltage due to a parasitic capacitance of the thin film transistor.

During the second frame FR2, the liquid crystal capacitor is charged with the negative data voltage NDV while the thin film transistor receives the gate signal Vg at the high level HL. Then, when the gate signal Vg is changed to the low level LL, the voltage charged in the liquid crystal capacitor is lowered down by the kickback voltage due to the parasitic capacitance of the thin film transistor.

Accordingly, a difference in variability (e.g., root-mean-square, RMS) occurs between the voltages charged in the liquid crystal capacitor during the first and second frames FR1 and FR2, and by this, a flicker occurs.

Figure 3:
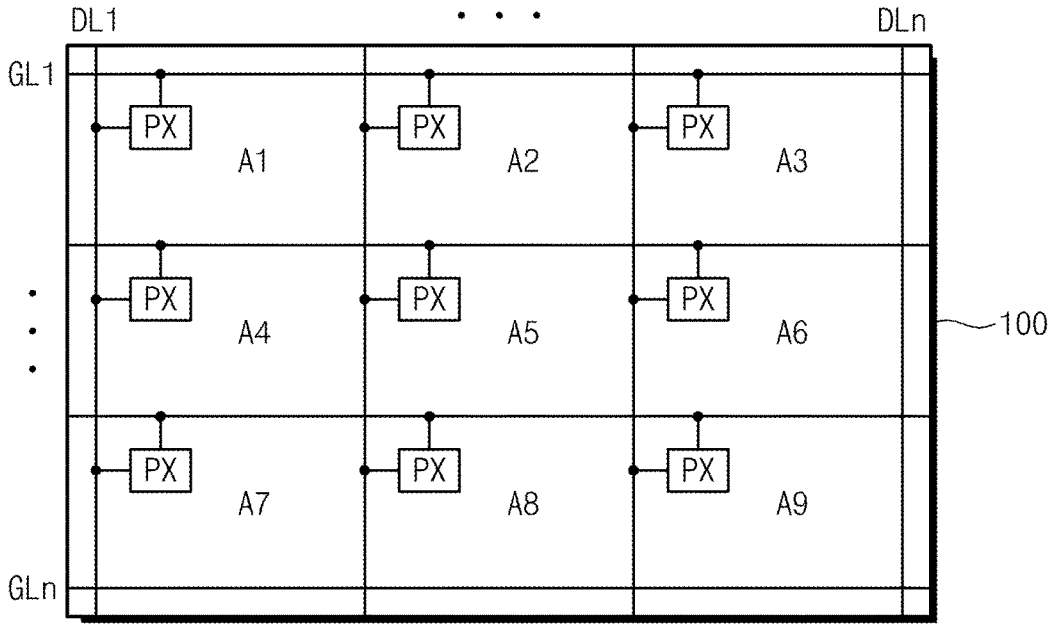
FIG. 3 is a plan view showing the display panel shown in FIG. 1.

FIG. 3 is a plan view showing the display panel 100 shown in FIG. 1.

Referring to FIG. 3, the display panel 100 includes first to ninth areas A1 to A9. The display panel 100 may include more or fewer areas, for example, each of the first to ninth areas A1 to A9 may include 9 areas. Each of the first to ninth areas A1 to A9 includes the pixel PX. In FIG. 3, only one pixel PX disposed in each of the first to ninth areas A1 to A9 has been shown, however, each of the first to ninth areas A1 to A9 may have more than one pixel.

The data voltage and the gate signal, which are applied to the pixel PX, may be distorted while being transmitted through the data lines DL1 to DLm and the gate lines GL1 to GLn. For instance, the data voltage and the gate signal may be distorted due to an RC signal delay caused by the data lines DL1 to DLm and the gate signals GL1 to GLn. Since the distortion of the data voltage and the gate signal appears in different forms depending on the first to ninth areas A1 to A9, levels of the kickback voltage generated in the thin film transistors respectively disposed in the first to ninth areas A1 to A9 are different from each other. Therefore, to remove the flicker caused by the kickback voltage, the kickback voltage is compensated in different ways according to the first to ninth areas A1 to A9.

Figure 4:
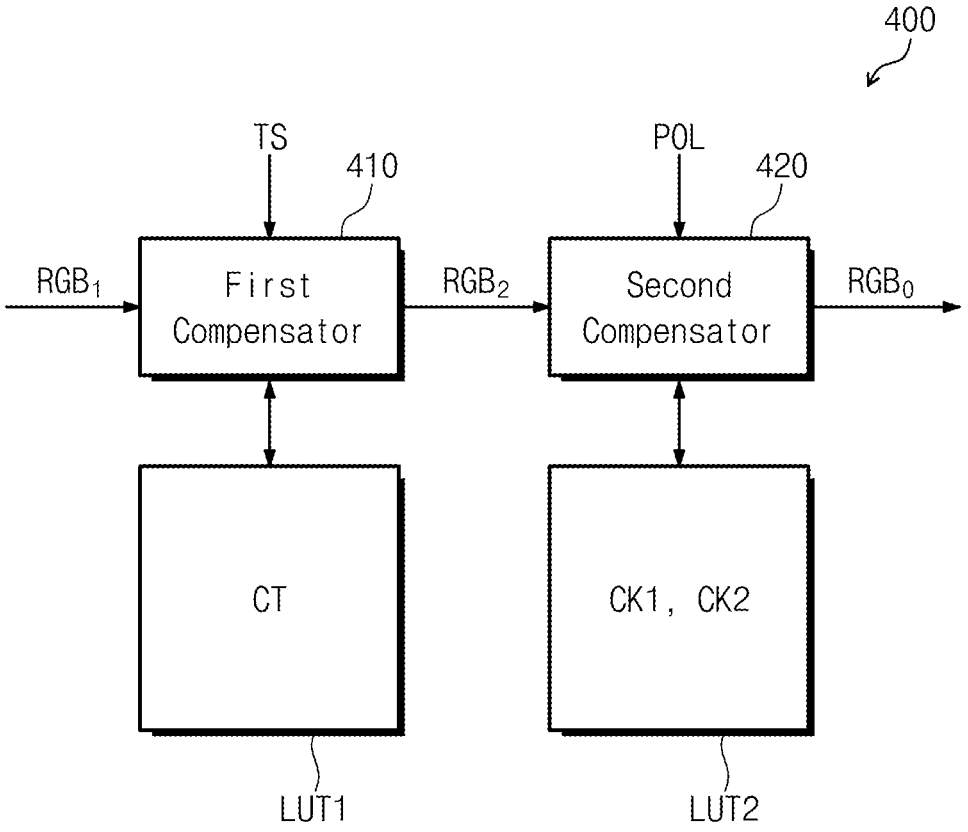
FIG. 4 is a block diagram showing a timing controller shown in FIG. 1.
Figure 5:
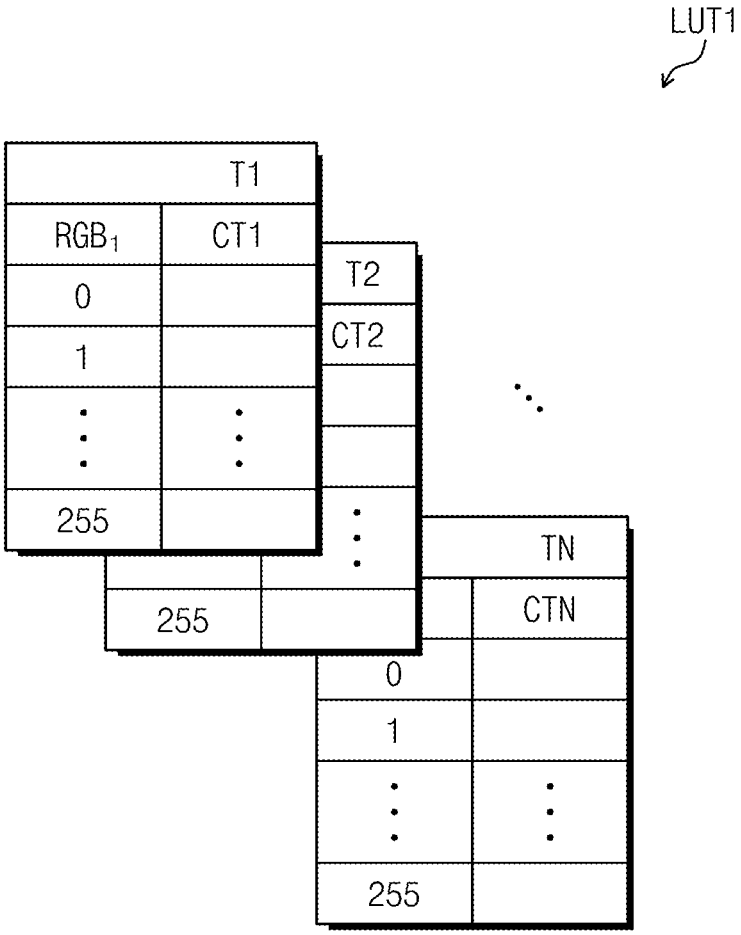
FIG. 5 is a view showing a first look-up table shown in FIG. 4.
Figure 6:
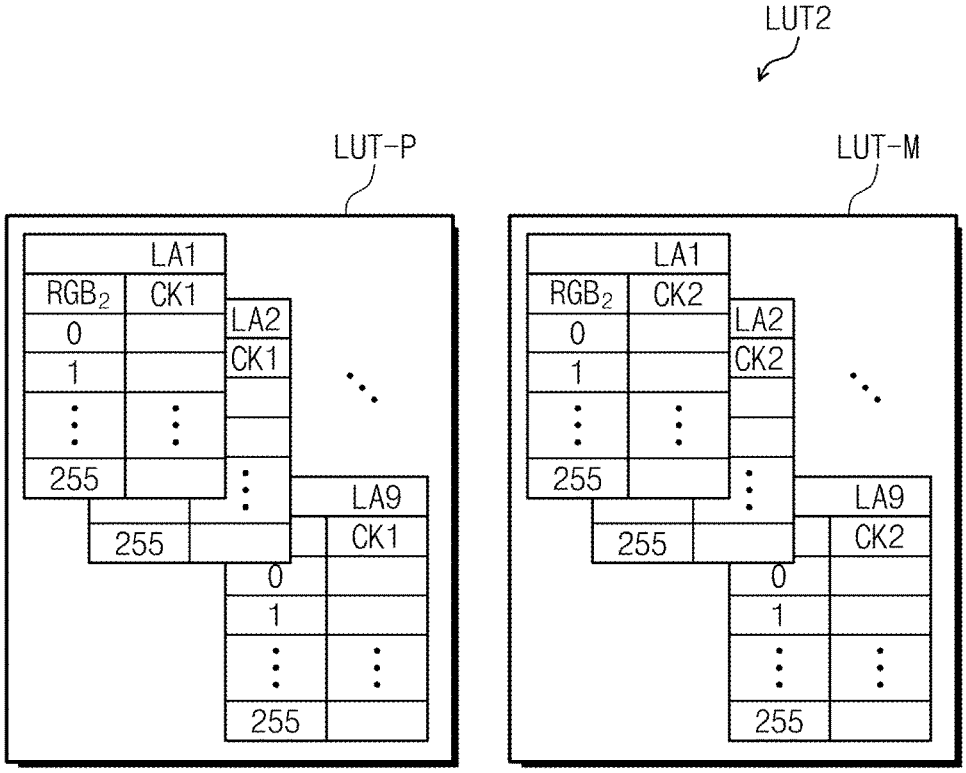
FIG. 6 is a view showing a second look-up table shown in FIG. 4.

FIG. 4 is a block diagram showing the timing controller shown in FIG. 1, FIG. 5 is a view showing a first look-up table shown in FIG. 4, and FIG. 6 is a view showing a second look-up table shown in FIG. 4.

Referring to FIGS. 1 and 4, the timing controller 400 includes a first compensator 410 and a second compensator 420.

As an example, the first and second compensators 410 and 420 are elements or components of the timing controller 400. However, according to exemplary embodiments, the first and second compensators 410 and 420 may be provided separately from the timing controller 400 in a card or board shape. In this case, the first and second compensators 410 and 420 are disposed between the image source 10 and the timing controller 400 or included in a device or unit, which is connected between the image source 10 and the timing controller 400.

The first compensator 410 receives a first image data $RGB_1$ and receives the temperature signal TS from the temperature sensor 500. The first image data $RGB_1$ may be the input image data $RGB_i$, but it should not be limited thereto or thereby. For example, the first image data $RGB_1$ may be data generated by processing the input image data $RGB_i$ using another part external from or included in the timing controller 400.

The first compensator 410 selects a temperature compensation value CT in response to the external temperature sensed by the temperature sensor 500 and converts the first image data $RGB_1$ to a second image data $RGB_2$ on the basis of the selected temperature compensation value CT.

The second compensator 420 receives the second image data $RGB_2$, selects a predetermined kickback voltage compensation value in accordance with the first to ninth areas A1 to A9, and converts the second image data $RGB_2$ to the output image data $RGB_0$ on the basis of the kickback voltage compensation value selected in accordance with the first to ninth areas A1 to A9. Although described as output image data RCBo, aspects need not be limited thereto such that the signal or data output from the second compensator 420 may be further manipulated and/or processed to arrive at the output image data RCBo.

The timing controller 400 further includes first and second look-up tables LUT1 and LUT2. The first and second compensators 410 and 420 refer to the first and second look-up tables LUT1 and LUT2, respectively.

Hereinafter, the operation of the first compensator 410 will be described in more detail with reference to FIG. 5. The temperature compensation value CT includes predetermined first to N-th sub-temperature compensation values CT1 to CTN according to external temperature. In general, a temperature of the liquid crystal layer (not shown) in the display panel 100 varies depending on a variation of the external temperature. As a result, a viscosity of the liquid crystal layer and a liquid crystal capacitance formed by the liquid crystal layer are varied. Since a gamma characteristic of the display panel 100 is changed in accordance with the viscosity of the liquid crystal layer and the variation of the liquid crystal capacitance, the first to N-th sub-temperature compensation values CT1 to CTN may be predetermined to compensate for the variation of the gamma characteristic, which is caused by the external temperature.

The first look-up table LUT1 includes first to N-th temperature look-up tables T1 to TN to respectively store the first to N-th sub-temperature compensation values CT1 to CTN. The predetermined first to N-th sub-temperature compensation values CT1 to CTN set by gray-scales of the first image data $RGB_i$ are stored in the first to N-th temperature look-up tables T1 to TN, respectively.

The first compensator 410 converts the first image data $RGB_1$ to the second image data $RGB_2$ with reference to the first look-up table LUT1. In more detail, the first compensator 410 receives the temperature signal TS, extracts the external temperature from the temperature signal TS, and selects the temperature compensation value CT of a temperature look-up table corresponding to the external temperature among the first to N-th temperature look-up tables T1 to TN.

Then, the first compensator 410 applies the temperature compensation value CT to the first image data $RGB_1$ to generate the second image data $RGB_2$. For example, the temperature compensation value CT may be added to the first image data $RGB_1$ to generate the second image data $RGB_2$.

Hereinafter, the second compensator 420 will be described in more detail with reference to FIG. 6.

According to exemplary embodiments, the kickback voltage compensation value includes a first sub-kickback voltage compensation value CK1 and a second sub-kickback voltage compensation value CK2.

The second compensator 420 receives the polarity signal POL and converts the second image data $RGB_2$ to the output image data $RGB_0$ using one of the first and second sub-kickback compensation values CK1 and CK2 in response to the polarity signal POL.

The first and second sub-kickback compensation values CK1 and CK2 are previously set to correspond to the first to ninth areas A1 to A9. In more detail, the first and second sub-kickback voltage compensation values CK1 and CK2 are set to compensate for the different kickback voltages of each of the first to ninth areas A1 to A9. The first sub-kickback voltage compensation value CK1 is set to compensate for the kickback voltage generated in the first frame FR1 (refer to FIG. 2) in which the positive data voltage PDV (refer to FIG. 2) is applied, and the second sub-kickback voltage compensation value CK2 is set to compensate for the kickback voltage generated in the second frame FR2 (refer to FIG. 2) in which the negative data voltage NDV (refer to FIG. 2) is applied.

As an example, the second look-up table LUT2 includes a positive look-up table LUT-P to store the first sub-kickback voltage compensation value CK1 and a negative look-up table LUT-M to store the second sub-kickback voltage compensation value CK2.

Each of the positive and negative look-up tables LUT-P and LUT-M includes first to ninth kickback look-up tables LA1 to LA9 respectively corresponding to the first to ninth areas A1 to A9. If the display panel 100 includes more or fewer areas, the positive and negative look-up tables LUT-P and LUT-M may include more or fewer look-up tables to correspond to the areas. In addition, the first sub-kickback voltage compensation value CK1 previously set by the gray-scales of the second image data $RGB_2$ is stored in the first to ninth kickback look-up tables LA1 to LA9 of the positive look-up table LUT-P. The second sub-kickback voltage compensation value CK2 previously set by the gray-scales of the second image data $RGB_2$ is stored in the first to ninth kickback look-up tables LA1 to LA9 of the negative look-up table LUT-M.

The second compensator 420 converts the second image data $RGB_2$ to the output image data $RGB_0$ with reference to the second look-up table LUT2. In more detail, the second compensator 420 receives the polarity signal POL and selects one of the positive look-up table LUT-P and the negative look-up table LUT-M in response to the polarity signal POL.

Then, the second compensator 420 applies one of the first and second sub-kickback voltage compensation values CK1 and CK2 to the second image data $RGB_2$ in accordance with the first to ninth areas A1 to A9 to generate the output image data $RGB_0$. For example, the second compensator 420 may add the one of the first and second sub-kickback voltage compensation values CK1 and CK2 to the second image data $RGB_2$ to generate the output image data $RGB_0$. For instance, the second image data $RGB_2$ includes first to ninth data packets corresponding to the first to ninth areas A1 to A9. The first sub-kickback voltage compensation value CK1 or the second sub-kickback voltage compensation value CK2 of the first to ninth kickback look-up tables LA1 to LA9 may be added to the first to ninth packets.

According to exemplary embodiments, the temperature compensation value CT may be previously set to correspond to a reference area. In more detail, the temperature compensation value CT may be previously set to compensate for the variation of the gamma characteristic of the reference area according to the external temperature.

Hereinafter, a method of setting the reference area will be described in more detail.

First, the temperatures of the first to ninth areas A1 to A9 of the display panel 100 are measured and an average temperature of the display panel 100 is calculated from the temperatures of the first to ninth areas A1 to A9. The temperatures of the first to ninth areas A1 to A9 may be measured by a temperature measuring device disposed outside the display device 1000.

Then, among the first to ninth areas A1 to A9, the area having the temperature nearest to the average temperature of the display panel 100 is set as the reference area. For instance, when the temperature of the fifth area A5 is nearest to the average temperature of the display panel 100, the fifth area A5 is set as the reference area and the temperature sensor 500 is disposed in the fifth area A5.

According to the above, the display device 1000 includes the first compensator 410 that compensates for the variation of the gamma characteristic of the display panel 100 due to the external temperature through the temperature compensation value CT and a second compensator 420 that reduces the flicker caused by the kickback voltages differently generated depending on the areas of the display panel 100 through the first and second sub-kickback voltage compensation values CK1 and CK2. Accordingly, the variation in display quality, which is causes by the external temperature and the locations of the areas and/or pixels, may be compensated, and thus the display device 1000 may have uniform display quality.

The level of the kickback voltage varies depending on a dielectric constant of the liquid crystal layer, and the dielectric constant of the liquid crystal layer varies depending on the temperature of the display panel 100, which is varied in accordance with the external temperature. The display device 1000 may compensate for the kickback voltage, which varies depending on the external temperature, using the first and second compensators 410 and 420 in each area.

Figure 7A:
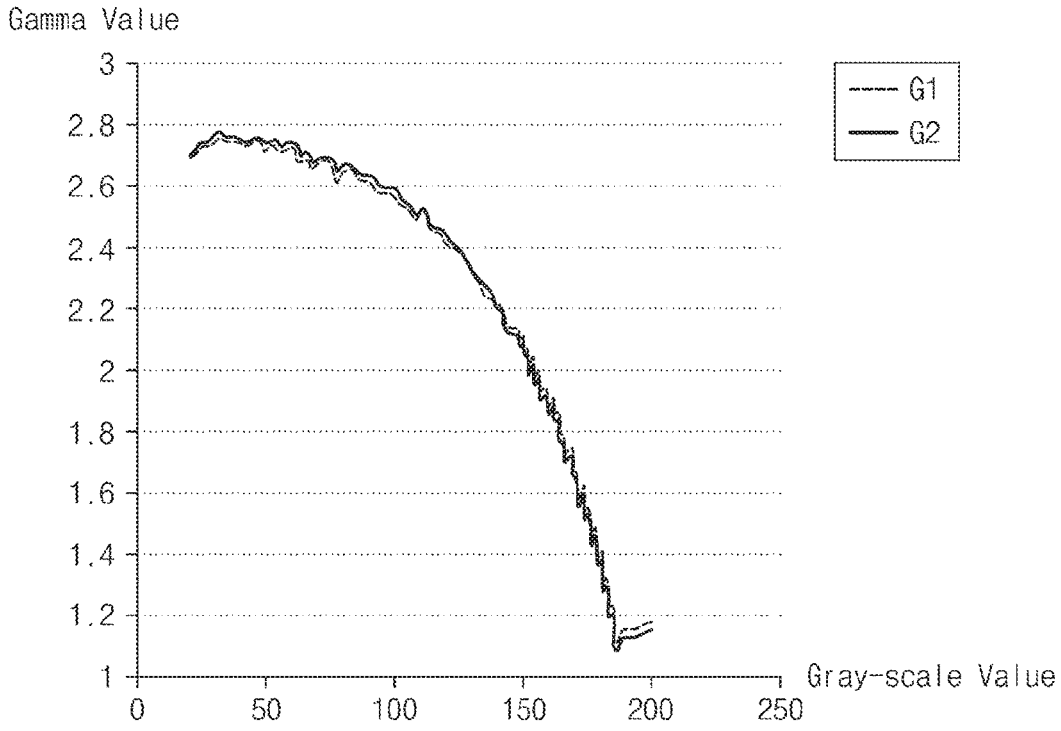
FIG. 7A (Prior Art)
FIG. 7A is a graph showing a gamma value of an image displayed in a conventional display device when an external temperature is about zero ° C.
Figure 7B:
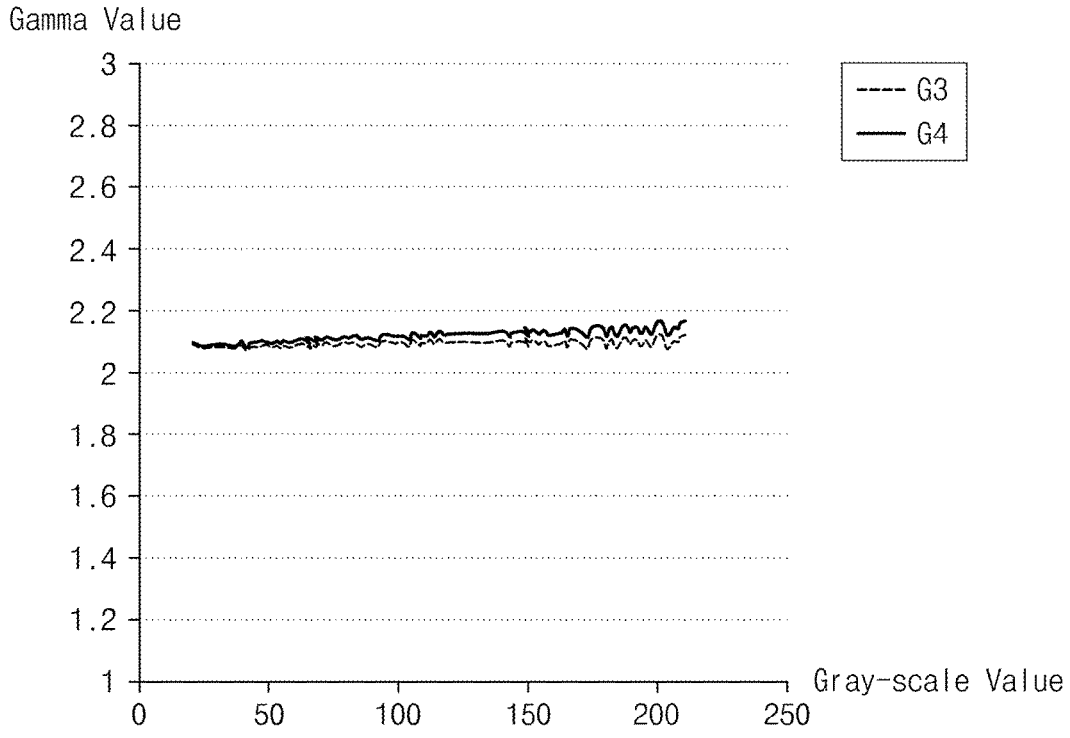
FIG. 7B is a graph showing a gamma value of an image displayed in a display device when an external temperature is about zero ° C. according to exemplary embodiments of the present disclosure.

FIG. 7A is a graph showing a gamma value of an image displayed in a conventional display device when an external temperature is about zero ° C. and FIG. 7B is a graph showing a gamma value of an image displayed in the display device 1000 when the external temperature is about zero ° C. according to exemplary embodiments of the present disclosure.

In FIG. 7A, an x-axis represents a gray-scale value and a y-axis represents a gamma value. First and second graphs G1 and G2 respectively represent gamma values according to the gray-scale values of the images displayed in the fifth and sixth areas A5 and A6 (refer to FIG. 3). When the conventional display device is operated under the condition that the external temperature is about zero ° C., the gamma values of the images displayed in the fifth and sixth areas A5 and A6 are extremely decreased as the gray-scale value is increased. As an example, according to the first graph G1 representing the gamma value of the image displayed in the fifth area A5, the gamma value is about 2.7 when the gray-scale value is about 25, the gamma value is about 2.2 when the gray-scale value is about 150, and the gamma value is about 1.4 when the gray-scale value is about 200.

In FIG. 7B, an x-axis represents a gray-scale value and a y-axis represents a gamma value. Third and fourth graphs G3 and G4 respectively represent gamma values according to the gray-scale values of the images displayed in the fifth and sixth areas A5 and A6 (refer to FIG. 3). When the display device 1000 is operated under the condition that the external temperature is about zero ° C., the gamma values of the fifth and sixth areas A5 and A6 are constantly maintained regardless of the variation of the gray-scale values. According to the third graph G3 representing the gamma value of the fifth area A5, the gamma value maintains about 2.1 even though the gray-scale value is changed from about zero to about 200.

As described above, the gamma characteristic of the display device 1000 is less sensitive to the external temperature compared with the conventional display device.

Figure 8A:
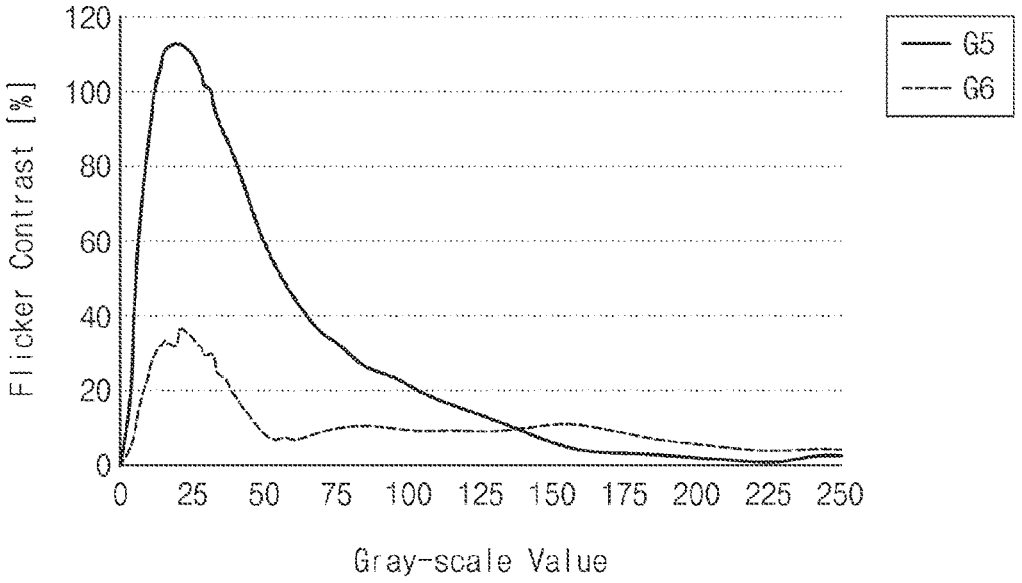
FIG. 8A (Prior Art)
FIG. 8A is a graph showing a flicker contrast occurring in a conventional display device.
Figure 8B:
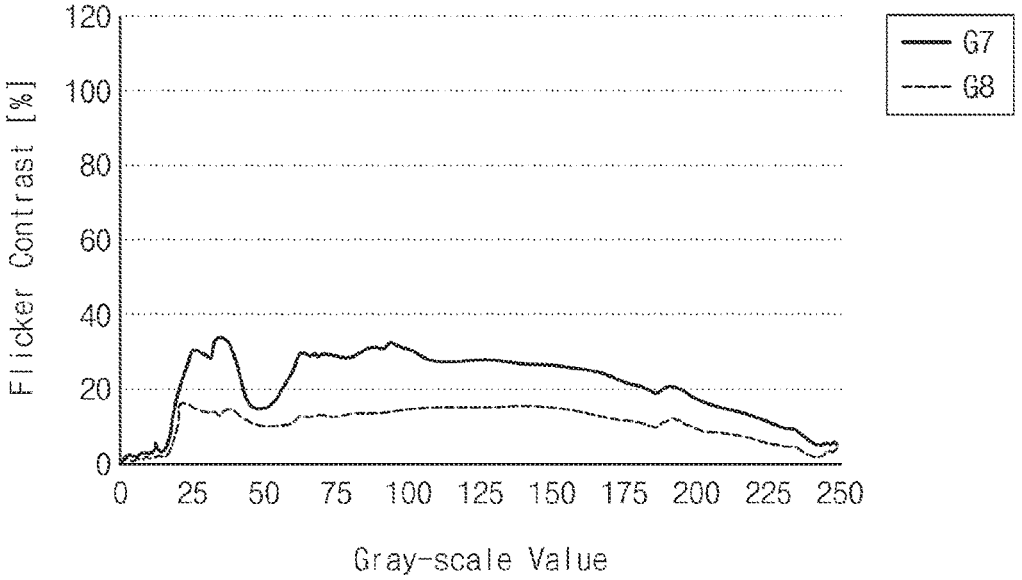
FIG. 8B is a graph showing a flicker contrast occurring in a display device according to exemplary embodiments of the present disclosure.

FIG. 8A is a graph showing a flicker contrast occurring in a conventional display device and FIG. 8B is a graph showing a flicker contrast occurring in a display device according to exemplary embodiments of the present disclosure.

In FIG. 8A, an x-axis represents a gray-scale value and a y-axis represents a flicker contrast. Fifth and sixth graphs G5 and G6 represent the flicker contrasts according to the gray-scale values of the images displayed in first and sixth areas A1 and A6 of the conventional display device, respectively. In the conventional display device, a maximum difference in the flicker contrast between the images displayed in the first and sixth areas A1 and A6 appears at about 25 gray-scale of the fifth and sixth graphs G5 and G6. The flicker difference in the flicker contrast between the fifth and sixth graphs G5 and G6 is about 90% at the 25 gray-scale.

In addition, a maximum value of the flicker contrast of the fifth graph G5 is about 115% at the 25 gray-scale.

In FIG. 8B, an x-axis represents the gray-scale value and a y-axis represents the flicker contrast. Seventh and eighth graphs G7 and G8 respectively represent the flicker contrasts according to the gray-scale values of the images displayed in first and sixth areas A1 and A6 of the display device according to exemplary embodiments.

According to exemplary embodiments, the maximum difference in the flicker contrast between the images displayed in the first and sixth areas A1 and A6 appears at about 30 gray-scale of the seventh and eighth graphs G7 and G8. The difference in the flicker contrast between the seventh and eighth graphs G7 and G8 is about 20% at the 30 gray-scale.

In addition, a maximum value of the flicker contrast of the seventh graph G7 is about 37% at the 30 gray-scale.

As described above, the maximum value of the flicker contrast of the display device 1000 is smaller than the maximum value of the flicker contrast of the conventional display device. In addition, the difference in the flicker contrast between the images displayed in the first to ninth areas A1 to A9 is reduced.

Figure 9:
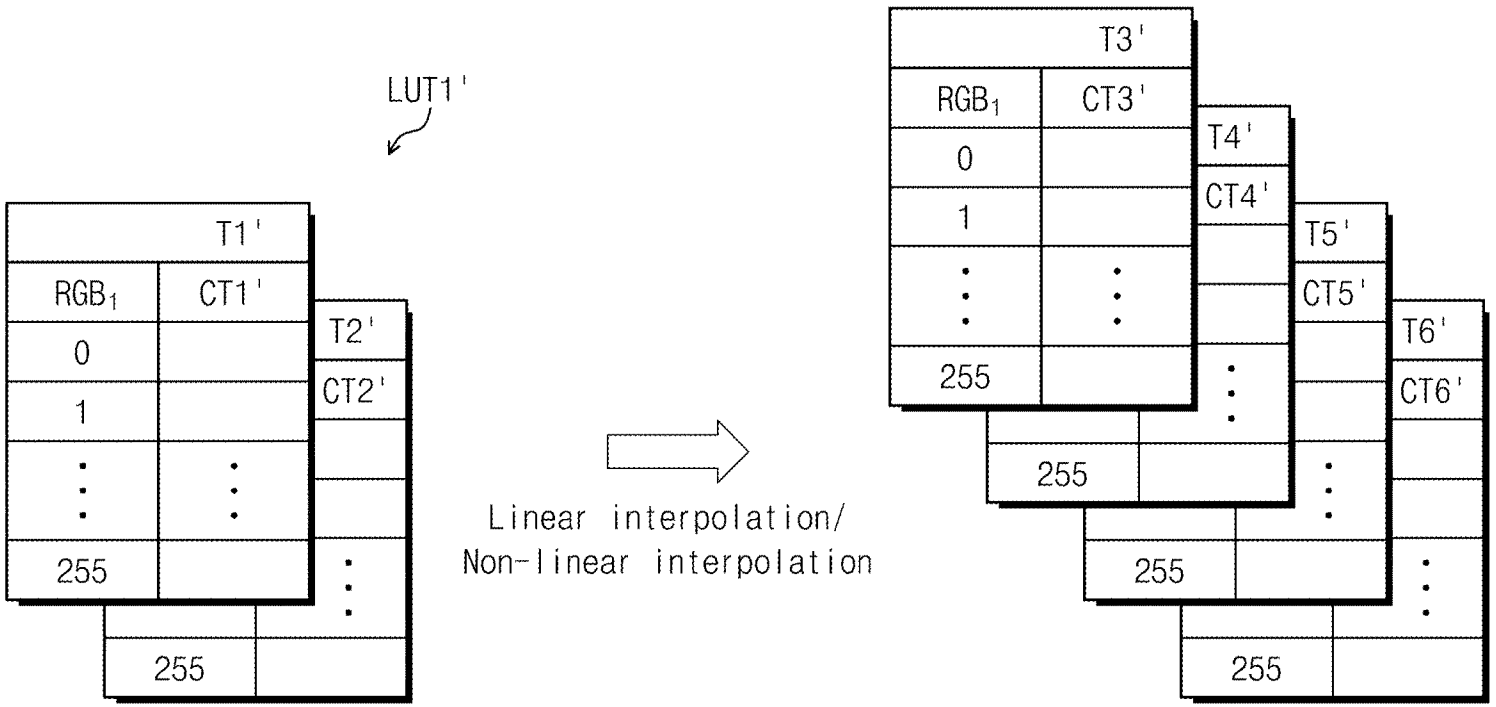
FIG. 9 is a view showing an operation of a first compensator according to exemplary embodiments of the present disclosure.

FIG. 9 is a view showing an operation of a first compensator according to exemplary embodiments of the present disclosure.

Referring to FIGS. 4 and 9, a first look-up table LUT1' includes first and second sub-temperature look-up tables T1 and T2. The first and second sub-temperature look-up tables T1' and T2' respectively store predetermined first and second sub-temperature compensation values CT1' and CT2' in response to the external temperature of about zero ° C. to about 50° C., respectively.

According to exemplary embodiments, the first compensator 410 linearly or non-linearly interpolates the first and second sub-temperature compensation values CT1' and CT2' to generate different temperature compensation values. For instance, the first compensator 410 linearly or non-linearly interpolates the first and second sub-temperature compensation values CT1' and CT2' to generate third, fourth, fifth, and sixth sub-temperature compensation values CT3', CT4', CT5', and CT6' respectively corresponding to the external temperature of about 10° C., about 20° C., about 30° C., and about 40° C. The third to sixth sub-temperature compensation values CT3' to CT6' are stored in third to sixth temperature look-up tables T3' to T6', respectively.

As described above, since the third to sixth sub-temperature compensation values CT3' to CT6' are generated from the first and second sub-temperature compensation values CT1' and CT2', the first compensator 410 more precisely compensates for the first image data $RGB_1$ on the basis of the third to sixth sub-temperature compensation values CT3' to CT6' and converts the first image data $RGB_1$ to the second image data $RGB_2$.

As another example, the first compensator 410 linearly or non-linearly interpolates only the first temperature compensation value CT1' to generate the third to sixth sub-temperature compensation values CT3' to CT6' and converts the first image data $RGB_1$ to the second image data $RGB_2$ on the basis of the third to sixth sub-temperature compensation values CT3' to CT6'.

Figure 10:
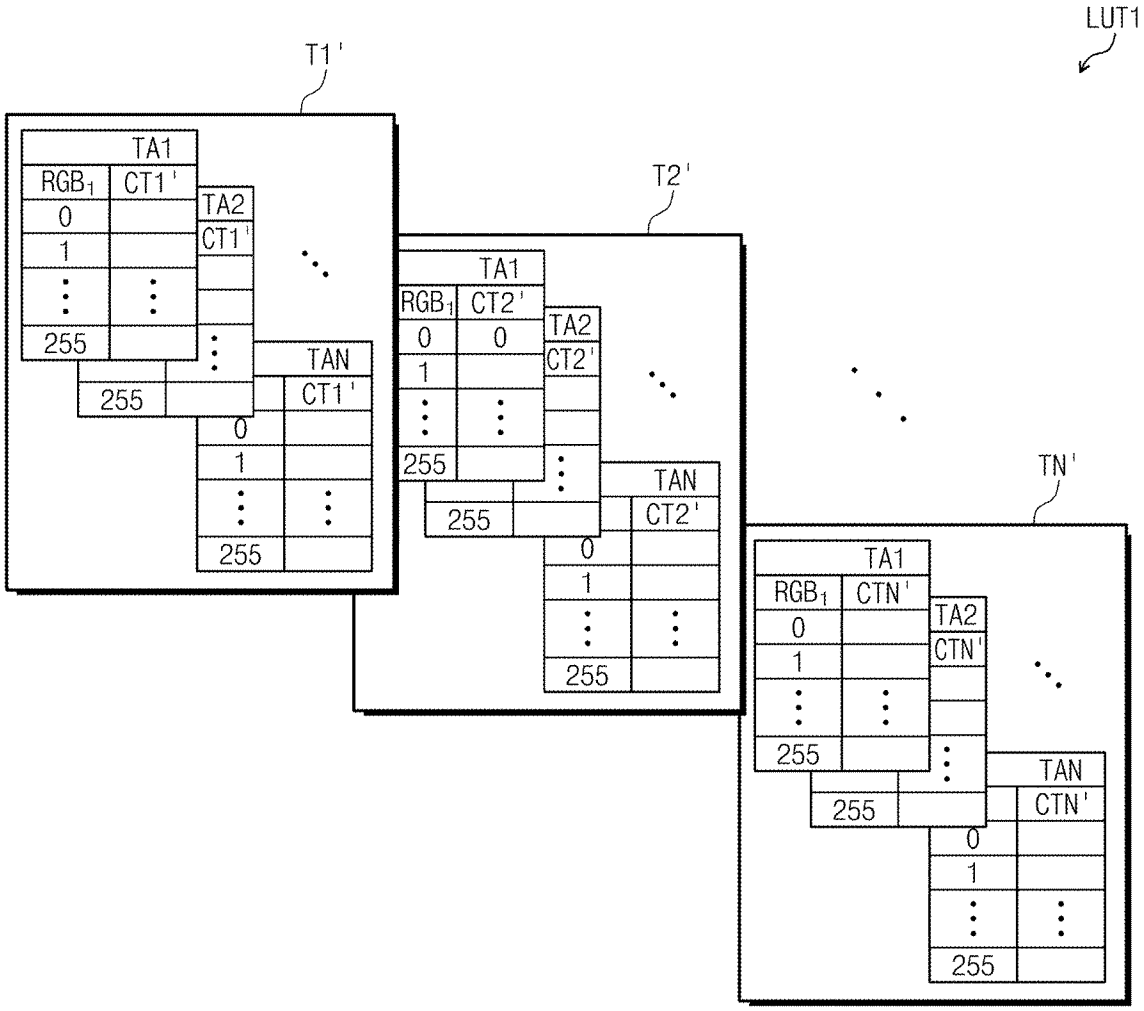
FIG. 10 is a view showing a first look-up table according to exemplary embodiments of the present disclosure.

FIG. 10 is a view showing a first look-up table according to exemplary embodiments of the present disclosure.

Referring to FIGS. 4 and 10, each of first to N-th temperature look-up tables T1' to TN' includes first to N-th sub-temperature look-up tables TA1 to TAN.

The temperature compensation value CT includes first to N-th sub-temperature compensation values CT1' to CTN' previously set in accordance with the external temperature. The first to N-th sub-temperature compensation values CT1' to CTN' are stored in each of the first to N-th sub-temperature look-up tables TA1 to TAN.

According to exemplary embodiments, the first to N-th sub-temperature compensation values CT1' to CTN' may be previously set to correspond to the first to ninth areas A1 to A9 (refer to FIG. 3). In more detail, the first to N-th sub-temperature compensation values CT1' to CTN' may be previously set to compensate for the gamma characteristic of the first to ninth areas A1 to A9 in accordance with the external temperature. For instance, the first sub-temperature compensation value CT1' stored in the first sub-temperature look-up table TA1 may be set to compensate for the variation of the gamma characteristic in the first area A1 when the external temperature is a first temperature.

The first to N-th sub-temperature look-up tables TA1 to TAN respectively store the first to N-th sub-temperature compensation values CT1' to CTN', which are previously set according to the first image data $RGB_1$.

The first compensator 410 converts the first image data $RGB_1$ to the second image data $RGB_2$ with reference to the first look-up table LUT1. In more detail, the first compensator 410 receives the temperature signal TS, extracts the external temperature from the temperature signal TS, and selects the temperature look-up table corresponding to the external temperature among the first to N-th temperature look-up tables T1 to TN.

Then, the first compensator 410 applies, for example, by addition, the selected temperature look-up table to the first image data $RGB_1$ according to the first to ninth areas A1 to A9 to generate the output image data $RGB_0$. In more detail, the first image data $RGB_1$ includes first to ninth data packets corresponding to the first to ninth areas A1 to A9. The sub-temperature compensation value of the selected temperature look-up table may be applied to each of the first to ninth data packets.

As described above, when the first image data $RGB_1$ is converted to the second image data $RGB_2$ on the basis of the first to N-th sub-temperature compensation values CT1 to CTN according to the external temperature and the first to ninth areas A1 to A9, the flicker caused by the difference in temperature between the first to ninth areas A1 to A9 is more precisely reduced.

Figure 11:
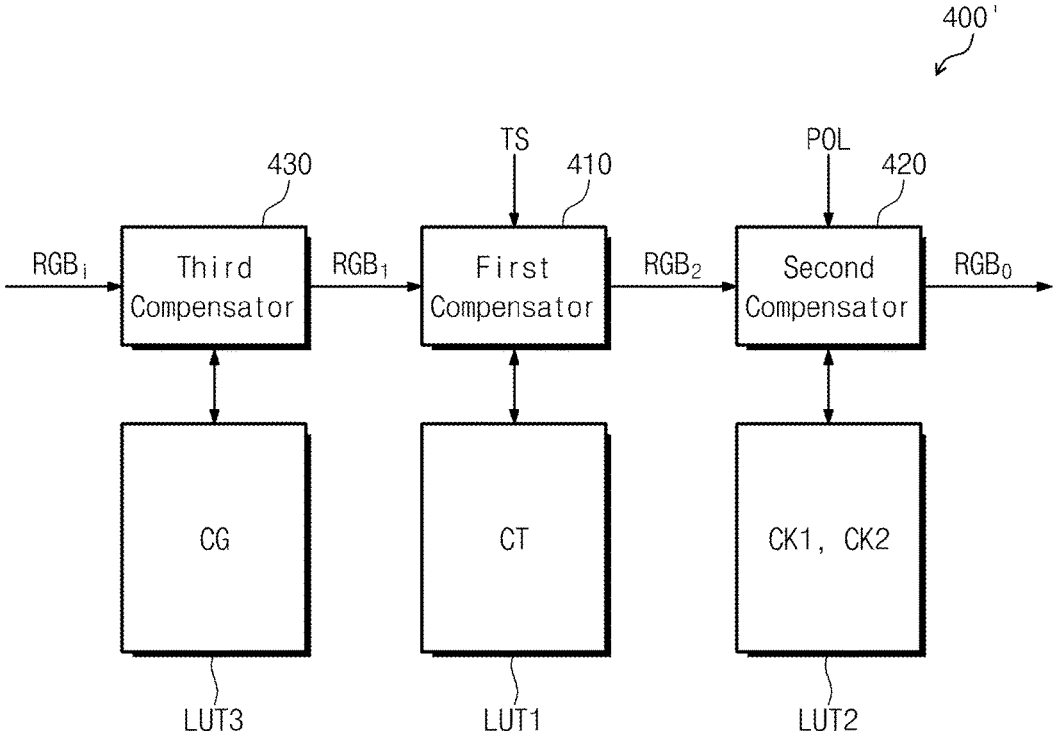
FIG. 11 is a block diagram showing a timing controller according to exemplary embodiments of the present disclosure.

FIG. 11 is a block diagram showing a timing controller according to exemplary embodiments of the present disclosure.

Referring to FIG. 11, a timing controller 400' includes the first compensator 410, the second compensator 420, and a third compensator 430. Detailed descriptions of the first and second compensators 410 and 420 will be omitted since the first and second compensators 410 and 420 have been described with reference to FIG. 4.

The third compensator 430 receives the input image data $RGB_i$ and converts the input image data $RGB_i$ to the first image data $RGB_1$ on the basis of a predetermined color compensation value CG.

The color compensation value CG is set in consideration of the gamma characteristic of the display panel 100 to control a color coordinate of the image displayed in the display panel 100. For instance, the color compensation value CG is set to facilitate a white image displayed in the display panel 100 close to a blue image and to allow x and/or y coordinate values in the color coordinate of the white image to be decreased. On the contrary, the color compensation value CG is set to facilitate the white image displayed in the display panel 100 close to a red image and to allow x and/or y coordinate values in the color coordinate of the white image to be increased.

The timing controller 400 may further include a third look-up table LUT3. The third look-up table LUT3 stores the color compensation value CG. The third compensator 430 converts the input image data $RGB_1$ to the first image data $RGB_1$ with reference to the third look-up table LUT3.

Figure 12:
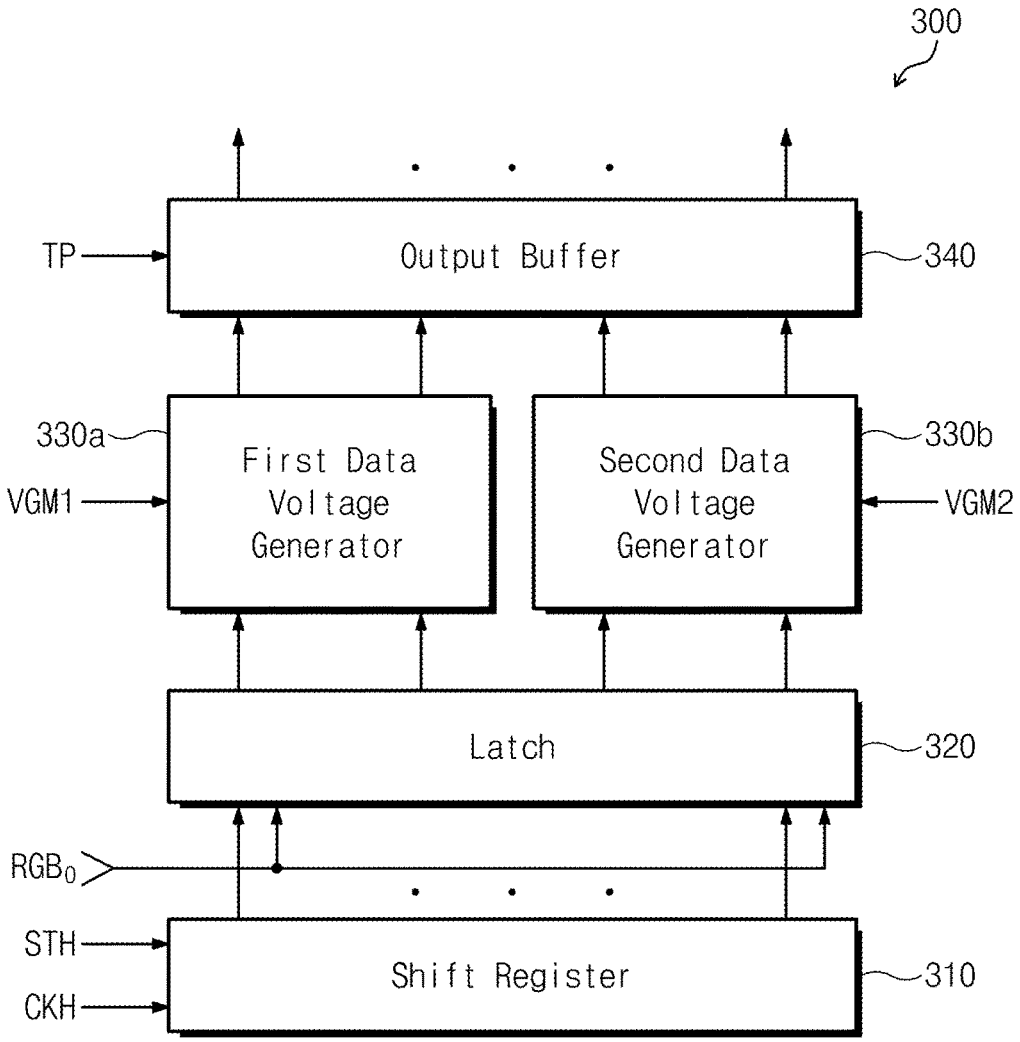
FIG. 12 is a block diagram showing a data driver according to exemplary embodiments of the present disclosure.

FIG. 12 is a block diagram showing a data driver according to exemplary embodiments of the present disclosure.

Referring to FIG. 12, the data driver 300 includes a shift register 310, a latch 320, a first data voltage generator 330*a*, a second data voltage generator 330*b*, and an output buffer 340.

The shift register 310 includes a plurality of stages (not shown) connected to each other one after another, each stage receives a horizontal clock signal CKH, and a first stage among the stages receives a horizontal start signal STH. When the first stage starts its operation in response to the horizontal start signal STH, the stages sequentially outputs control signals in response to the horizontal clock signal CKH.

The latch 320 receives the output image data $RGB_0$ from the timing controller 400 and sequentially latches the data among the output image data $RGB_0$, which corresponds to one line, in response to the control signals sequentially provided from the stages. The latch 320 applies the latched data corresponding to the one line to the first and second data voltage generators 330*a* and 330*b*.

The first data voltage generator 330*a* receives the data from the latch 320 and converts the received data to a high-gamma data voltage HDV on the basis of a first gamma reference voltage VGM1.

The second data voltage generator 330*b* receives the data from the latch 320 and converts the received data to a low-gamma data voltage LDV on the basis of a second gamma reference voltage VGM2.

The first gamma reference voltage VGM1 has a voltage level higher than that of the second gamma reference voltage VGM2. Therefore, the first data voltage generator 330*a* may generate the high-gamma data voltage HDV having the voltage level higher than that of the low-gamma data voltage LDV.

The output buffer 340 is configured to include a plurality of OP-amps (not shown), and outputs the high-gamma data voltage HDV and/or the low-gamma data voltage LDV received from the first and second data voltage generators 330*a* and 330*b* at the same time point in response to the output start signal TP.

Figure 13:
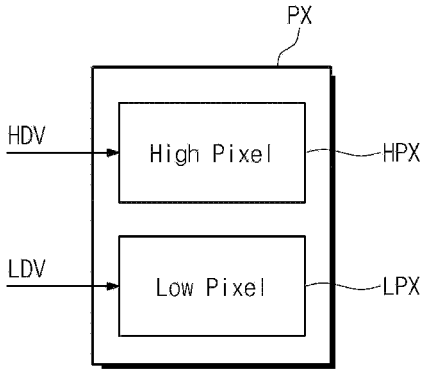
FIG. 13 is a plan view showing a pixel according to exemplary embodiments of the present disclosure.

FIG. 13 is a plan view showing a pixel according to exemplary embodiments of the present disclosure.

Referring to FIG. 13, the pixel PX includes a high pixel HPX and a low pixel LPX. The high pixel HPX receives the high-gamma data voltage HDV and the low pixel LPX receives the low-gamma data voltage LDV having the voltage level lower than that of the high-gamma data voltage HDV. As a result, the image displayed in the high pixel HPX has a first brightness corresponding to the high-gamma data voltage HDV and the image displayed in the low pixel LPX has a second brightness corresponding to the low-gamma data voltage LDV. The first brightness has a value greater than a value of the second brightness. As described above, when the pixel PX includes the high and low pixels HPX and LPX that display the images having different brightnesses, a side visibility of the pixel PX may be improved. In addition, since the data driver 300 includes the first and second data voltage generators 330*a* and 330*b*, the data driver 300 may generate the high- and low-gamma data voltages HDV and LDV using one output image data $RGB_0$.

Figure 14:
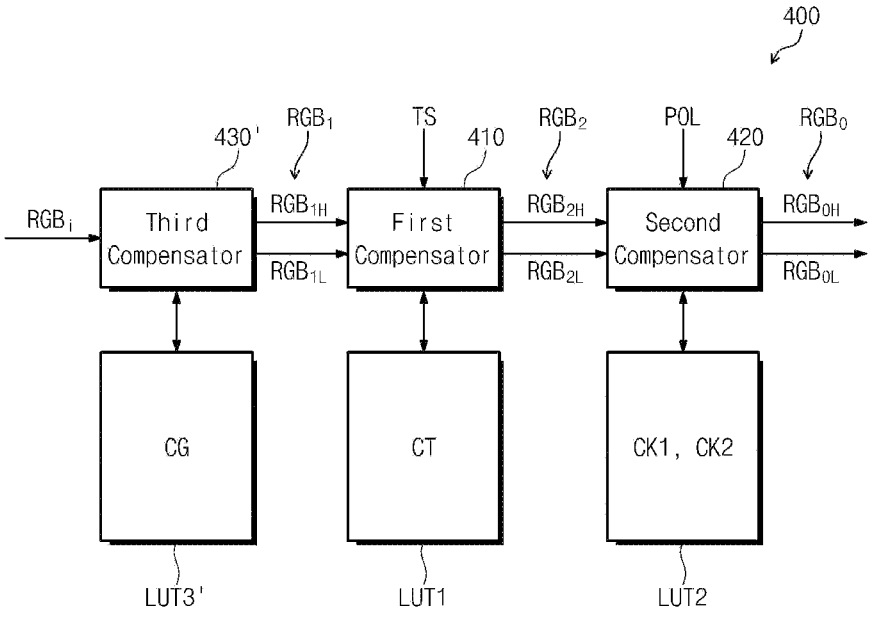
FIG. 14 is a block diagram showing a timing controller according to exemplary embodiments of the present disclosure.
Figure 15:
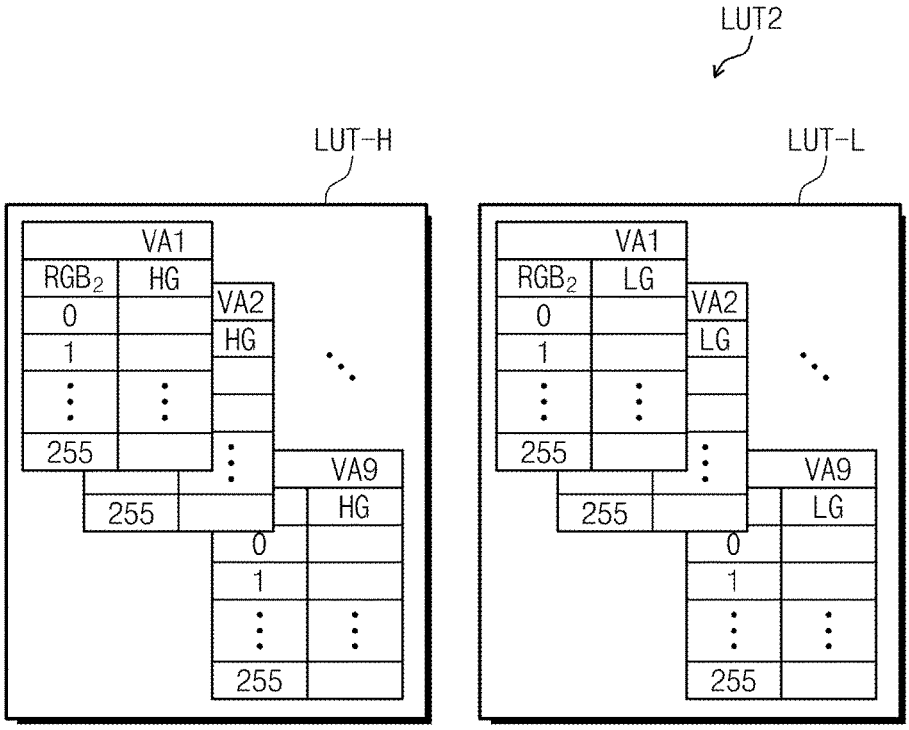
FIG. 15 is a view showing a third look-up table shown in FIG. 14.

FIG. 14 is a block diagram showing a timing controller according to exemplary embodiments of the present disclosure and FIG. 15 is a view showing a third look-up table shown in FIG. 14.

Referring to FIGS. 14 and 15, the timing controller 400 includes the first compensator 410, the second compensator 420, a third compensator 430', and a third look-up table LUT3'.

The color compensation value CG includes a high-color compensation value HG and a low-color compensation value LG. The third look-up table LUT3' includes a high look-up table LUT-H to store the high-color compensation value HG and a low look-up table LUT-L to store the low-color compensation value LG.

The high-color compensation value HG and the low-color compensation value LG are determined to improve the side visibility. For instance, the high-color compensation value HG may be generated on the basis of a first gamma value and the low-color compensation value LG may be generated on the basis of a second gamma value greater than the first gamma value. The high- and low-color compensation values HG and LG may be previously set to correspond to the first to ninth areas A1 to A9 (refer to FIG. 3). In more detail, the high- and low-color compensation values HG and LG are set to compensate for the color difference between the images displayed in the first to ninth areas A1 to A9.

Each of the high and low look-up tables LUT-H and LUT-L includes first to N-th visible look-up tables VA1 to VA9 that respectively correspond to the first to ninth areas A1 to A9. If the display panel 100 includes more or fewer areas, the high and low look-up tables LUT-H and LUT-L may include more or fewer look-up tables to correspond to the areas. In addition, the first to N-th visible look-up tables VA1 to VA9 of the high look-up table LUT-H store the high-color compensation value HG previously set according to the gray-scales of the input image data $RGB_i$. The first to N-th visible look-up tables VA1 to VA9 of the low look-up table LUT-L store the low-color compensation value LG previously set according to the gray-scales of the input image data $RGB_i$.

The third compensator 430' converts the input image data $RGB_i$ to a first high image data $RGB_{1H}$ on the basis of the high-color compensation value HG and the low-color compensation value LG converts the input image data $RGB_1$ to a first low image data $RGB_{1f}$ on the low-color compensation value LG.

For instance, the third compensator 430' applies, for example, by addition, the high- and low-color compensation values HG and LG to the input image data $RGB_i$ according to the first to ninth areas A1 to A9 to generate the first image data $RGB_1$. That is, the input image data $RGB_1$ includes first to ninth data packets corresponding to the first to ninth areas A1 to A9. Then, the high- and low-color compensation values HG and LG of the first to N-th visible look-up tables VA1 to VA9 are applied, for example, by addition, to the first to ninth data packets, and thus the first high image data $RGB_{1H}$ and the first low image data $RGB_{1L}$.

The third compensator 430' outputs the first high image data $RGB_{1H}$ and the first low image data $RGB_{1L}$ as the first image data $RGB_1$.

The first compensator 410 receives the first high image data $RGB_{1H}$ and the first low image data $RGB_{1L}$ from the third compensator 430'.

The first compensator 410 converts the first high image data $RGB_{1H}$ and the first low image data $RGB_{1L}$ to second high image data $RGB_{2H}$ and second low image data $RGB_{2L}$, respectively, on the basis of the selected temperature compensation value CT and outputs the second high image data $RGB_{2H}$ and the second low image data $RGB_{2L}$ as the second image data $RGB_2$.

The second compensator 420 receives the second high image data $RGB_{2H}$ and the second low image data $RGB_{2L}$ from the first compensator 410.

The second compensator 420 converts the second high image data $RGB_{2H}$ and the second low image data $RGB_{2L}$ to output high image data $RGB_{OH}$ and output low image data $RGB_{OL}$, respectively, on the basis of the selected kickback voltage compensation value CK and outputs the third high image data $RGB_{OH}$ and the third low image data $RGB_{OL}$ as the output image data RGBo.

Then, the data driver 300 (refer to FIG. 1) converts the output high image data $RGB_{OH}$ of the output image data RGBo to the high-gamma data voltage HDV (refer to FIG. 13) and converts the output low image data $RGB_{OL}$ of the output image data RGBo to the low-gamma data voltage LDV (refer to FIG. 13).

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device comprising:

a timing controller to generate output image data;

a data driver to convert the output image data to a data voltage;

a display panel comprising a plurality of areas to display an image in accordance with the data voltage; and a temperature sensor to sense an external temperature, wherein the timing controller comprises:

a first compensator configured to receive input image data and convert the input image data to first image data on the basis of a color compensation value;

a second compensator configured to receive the first image data, to select a temperature compensation value according to the external temperature, and to convert the first image data to second image data on the basis of the selected temperature compensation value; and a third compensator configured to select a kickback voltage compensation value according to an area from among the plurality of areas and to convert the second image data to the output image data on the basis of the selected kickback voltage compensation value, wherein:

the color compensation value comprises a high-color compensation value and a low-color compensation value;

the first compensator converts the input image data to first high image data on the basis of the high-color compensation value, converts the input image data to first low image data on the basis of the low-color compensation value, and outputs the first high image data and the first low image data as the first image data;

the second compensator converts the first high image data and the first low image data to second high image data and second low image data, respectively, on the basis of the selected temperature compensation value and outputs the second high image data and the second low image data as the second image data; and the third compensator converts the second high image data and the second low image data to output high image data and output low image data, respectively, on the basis of the kickback voltage compensation value selected according to the areas and outputs the output high image data and the output low image data as the output image data.

2. The display device of claim 1, wherein the kickback voltage compensation value comprises a first sub-kickback voltage compensation value and a second sub-kickback voltage compensation value, and the third compensator converts the second image data to the output image data using one of the first and second sub-kickback voltage compensation values in response to a polarity signal.

3. The display device of claim 2, wherein the data driver converts the output image data to a positive data voltage or a negative data voltage in response to the polarity signal.

4. The display device of claim 1, wherein the display panel comprises a pixel configured to include a high pixel receiving a high-gamma data voltage and a low pixel receiving a low-gamma data voltage having a voltage level lower than a voltage level of the high-gamma data voltage.

5. The display device of claim 4, wherein the data driver comprises:

a first data voltage generator converting the output image data to the high-gamma data voltage; and a second data voltage generator converting the output image data to the low-gamma data voltage.

6. The display device of claim 5, wherein the first data voltage generator receives a first gamma reference voltage and the second data voltage generator receives a second gamma reference voltage having a voltage level lower than a voltage level of the first gamma reference voltage.

7. The display device of claim 1, wherein the data driver converts the output high image data of the output image data to a high-gamma data voltage and converts the output low image data of the output image data to a low-gamma data voltage.

8. The display device of claim 1, wherein:

the high-color compensation value and the low-color compensation value are set to correspond to the areas; and the first compensator selects the high-color compensation value and the low-color compensation value in accordance with the areas and converts the input image data to the first high image data and the first low image data on the basis of the high-color compensation value and the low-color compensation value, which are selected according to the areas.

9. The display device of claim 1, wherein:

the timing controller further comprises a look-up table in which the temperature compensation value is stored; and the second compensator refers to the look-up table and adds the temperature compensation value to the first image data to generate the second image data.

10. The display device of claim 1, wherein:

the temperature compensation value comprises a first temperature compensation value set to correspond to a first external temperature; and the second compensator linearly or non-linearly interpolates the first temperature compensation value to generate a second temperature compensation value corresponding to a second external temperature different from the first external temperature and converts the first image data to the second image data on the basis of the second temperature compensation value.

11. The display device of claim 10, wherein:

the temperature compensation value further comprises a third temperature compensation value set to correspond to a third external temperature different from the first and second external temperatures; and the second compensator linearly or non-linearly interpolates the first and third temperature compensation values to generate the second temperature compensation value.

12. The display device of claim 1, wherein:

the timing controller further comprises a look-up table in which the kickback voltage compensation value is stored; and the third compensator refers to the look-up table and adds the kickback voltage compensation value to the second image data to generate the output image data.

13. A method of driving a display device, comprising:

generating output high image data and output low image data;

converting the output high image data and the output low image data to a high-gamma data voltage and a low-gamma data voltage, respectively;

displaying an image in accordance with the high-gamma data voltage and the low-gamma data voltage; and sensing an external temperature, wherein the generating of the output high image data and output low image data comprises:

receiving input image data;

converting the input image data to first high image data and first low image data on the basis of a high-color compensation value and a low-color compensation value, respectively;

selecting a temperature compensation value in accordance with the external temperature;

converting the first high image data and the first low image data to second high image data and second low image data, respectively, on the basis of the selected temperature compensation value;

selecting a kickback voltage compensation value predetermined in accordance with a plurality of areas of a display panel according to the areas; and converting the second high image data and the second low image data to the output high image data and the output low image data, respectively, on the basis of the kickback voltage compensation value selected according to the areas.

14. The display device of claim 1, wherein:

the temperature compensation value is set to correspond to a reference area among the plurality of areas, the reference area being an area having a temperature nearest to an average temperature of the entire display panel; and the temperature sensor is disposed on the reference area among the plurality of areas.

15. The method of driving a display device of claim 13, wherein the temperature compensation value is set from a temperature sensor disposed on a reference area among the plurality of areas, the reference area being an area having a temperature nearest to an average temperature of the entire display panel.

* * * * *